US006612875B1

(12) United States Patent
Liao

(10) Patent No.: US 6,612,875 B1
(45) Date of Patent: Sep. 2, 2003

(54) MULTIFUNCTIONAL VEHICLE ADAPTER

(76) Inventor: Sheng Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 10/188,915

(22) Filed: Jul. 5, 2002

(51) Int. Cl.[7] ..... H01R 24/00; H01R 33/20
(52) U.S. Cl. ..... 439/675; 439/668; 439/638
(58) Field of Search ..... 439/675, 668, 439/669, 638

(56) References Cited

U.S. PATENT DOCUMENTS 4,109,988 A * 8/1978 Olson ..... 439/265
4,248,494 A * 2/1981 McDonald et al. ..... 439/638
5,007,863 A * 4/1991 Xuan ..... 439/639
5,199,904 A * 4/1993 Wharton ..... 439/668
5,961,353 A * 10/1999 Rivenbark ..... 439/668
6,305,945 B1 * 10/2001 Vance ..... 439/35
6,337,444 B1 * 1/2002 Liao ..... 174/135
6,379,178 B1 * 4/2002 Jones et al. ..... 439/501
6,402,546 B1 * 6/2002 Groves et al. ..... 439/501
6,416,355 B1 * 7/2002 Liao ..... 439/501
6,466,437 B1 * 10/2002 Sakuragi et al. ..... 361/686
6,478,628 B1 * 11/2002 Ming ..... 439/668
2002/0119708 A1 * 8/2002 Eisenbraun ..... 439/668

* cited by examiner

*Primary Examiner*—Lynn Feild
*Assistant Examiner*—Hae Moon Hyeon
(74) *Attorney, Agent, or Firm*—Rosenberg, Klien & Lee

(57) ABSTRACT

A multifunctional car adapter is provided. The multifunctional car adapter includes a main body with a first chamber formed therein. The main body has extending therefrom a connecting portion defining a second chamber. A plug unit is disposed in the second chamber, while a socket unit is disposed in the first chamber and is electrically connected with the plug unit. A circuit board is also disposed in the first chamber to be electrically coupled to the plug unit for Universal Serial Bus (USB) interface thereto. A USB connector is coupled to the circuit board for electrical connection to the plug unit.

16 Claims, 10 Drawing Sheets

MULTIFUNCTIONAL VEHICLE ADAPTER

BACKGROUND OF THE INVENTION

1. Field of the Invention

The present invention relates to a multifunctional vehicle power adaptor. More particularly, the present invention relates to an improved car cigarette lighter plug for adapting electronic apparatuses to car cigarette lighter sockets.

2. Description of the Prior Art

As the information technology develops, various portable electronic apparatuses such as laptop computers, cell phones, and personal digital assistants (PDA) have become popular than ever. These electronic apparatuses when used outdoor are typically powered by rechargeable batteries such as lithium battery, NiMH battery, or NiCd battery that are subject to low power situations. When the battery runs out of power, a charger is often needed.

Adapter that is able to insert into a car cigarette lighter socket is known in the art. However, the prior art adapter is not very convenient for use since once the adapter is inserted into the car cigarette lighter socket, the lighter plug has to be pulled out and cannot be used at one time.

SUMMARY OF THE INVENTION

It is a primary object of the present invention is to provide a multifunctional car adapter comprising at least a socket unit and a connector. When using the connector for charging or other purposes, the socket unit may be used at the same time for inserting a car cigarette lighter plug or other devices. Consequently, the adapter is convenient for use and is flexible.

According to the claimed invention, a multifunctional car adapter is provided. The multifunctional car adapter comprises a main body with a first chamber therein and a connecting portion, the connecting portion having a second chamber; a plug unit disposed in the second chamber; a socket unit disposed in the first chamber and being electrically connected with the plug unit; and a USB connector electrically connected with the plug unit.

It is to be understood that both the forgoing general description and the following detailed description are exemplary, and are intended to provide further explanation of the invention as claimed. Other advantages and features of the invention will be apparent from the following description, drawings and claims.

DETAILED DESCRIPTION OF THE PREFERRED EMBODIMENTS

Figure 1:
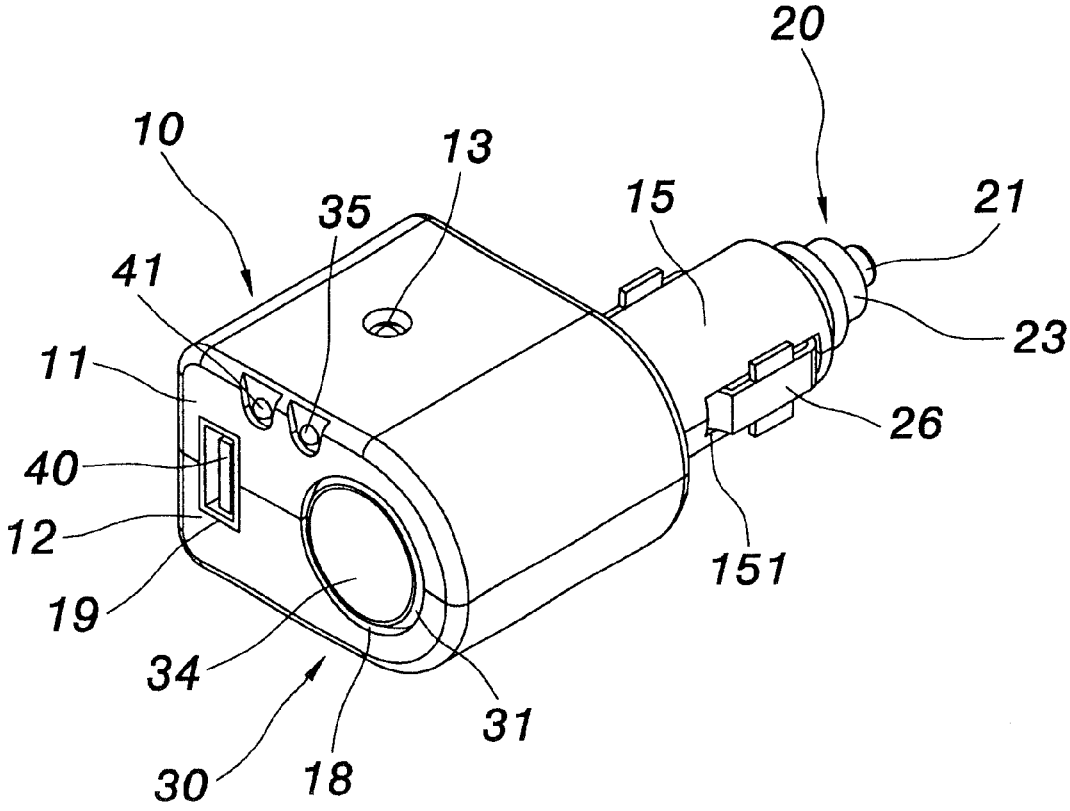
FIG. 1 is a typical view according to a first embodiment of this invention.
Figure 2:
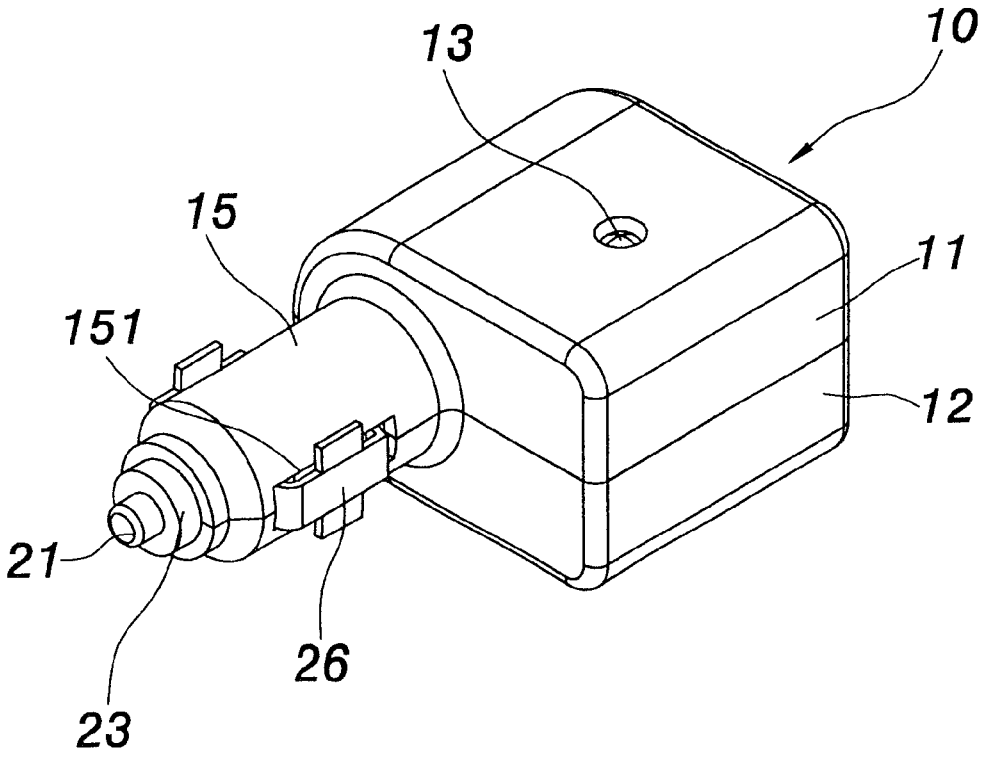
FIG. 2 is a perspective view of the first embodiment of this invention.
Figure 3:
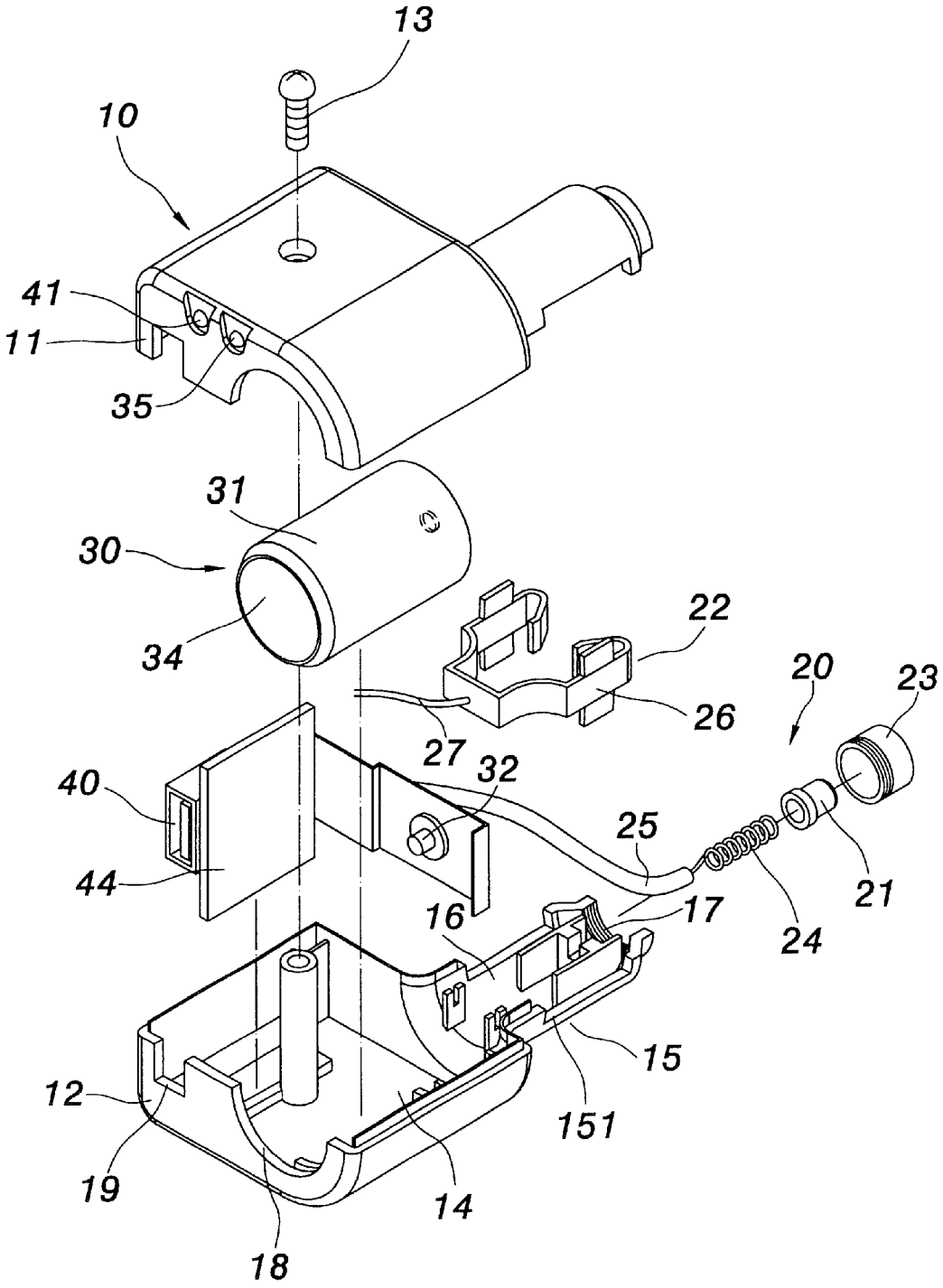
FIG. 3 is an exploded diagram of the first embodiment of this invention.
Figure 4:
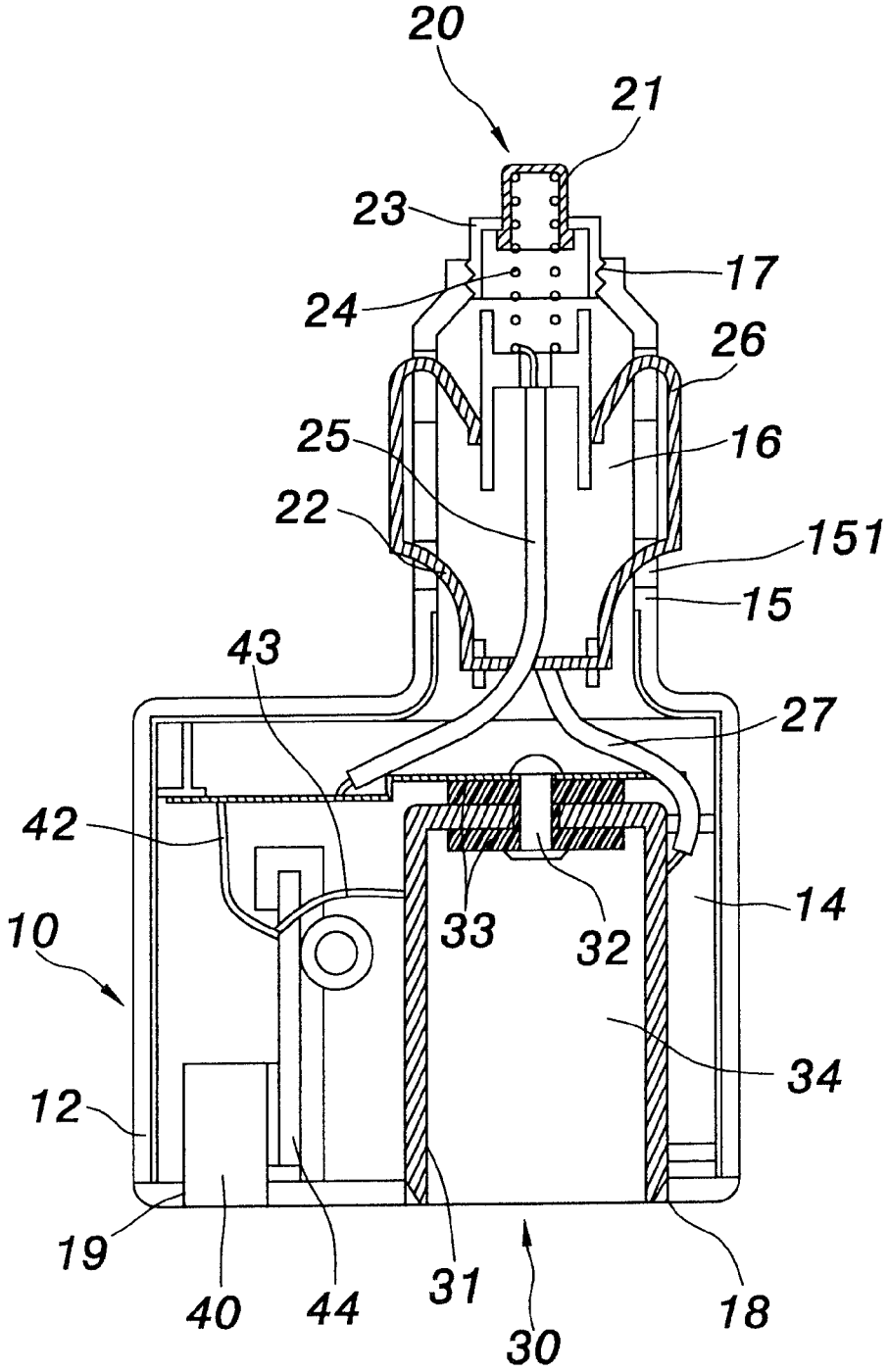
FIG. 4 is a side view of the first embodiment of this invention.

Please refer to FIG. 1 to FIG. 4. The present invention is directed to a multifunctional adapter that is capable of charging portable electronic devices in car, and at the same time, lighting the car cigarette lighter. As shown in figures, a multifunctional adapter comprises a main body 10, a plug unit 20, a socket unit 30, and a connector 40. The main body 10 is a hollow case consisting of a first half body 11 and a second half body 12. The second half body 12 may be locked on the first half body 11 by means of screws, wedges, or supersonic melting methods known in the art. It is understood that the shape of the main body 10 should not limited the scope of the present invention. A first chamber 14 is defined in the main body 10 for accommodating the socket unit 30 and the connector 40. The main body 10 has a cylindrical connecting portion 15 extending from one side of the main body 10. The cylindrical connecting portion 15 has a diameter that is approximately equivalent to the diameter of a car cigarette lighter socket. A second chamber 16 is defined in the cylindrical connecting portion 15. An opening 17 is located at one distal end of the connecting portion 15. The opening 17 connects the second chamber 16 with outer atmosphere. As best seen in FIG. 3, the second chamber 16 connects with the first chamber 14 in the main body 10. On the side opposite to the connecting portion 15, a first aperture 18 and a second aperture 19 are provided.

The plug unit 20 is disposed in the second chamber 16 of the main body 10. The plug unit 20 comprises a first terminal 21 and a second terminal 22. The first terminal 21 is composed of conductive materials. The first terminal 21 is movably installed on a base 23 that is fastened in the opening 17 at the distal end of the second chamber 16. The first terminal 21 protrudes from an outer surface of the base 23. Preferably, the first terminal 21 locates at the center of the connecting portion 15. A spring 24 is in connection with the first terminal 21 for pushing the first terminal 21 out of the base 23. One end of the spring 24 is connected with a fourth terminal 32 and the connector 40 through a transferring line 25.

The second terminal 22 is made of flexible conductive materials. The second terminal 22 is disposed and fixed in the second chamber 16. The second terminal 22 is properly folded in a shape that each end of the second terminal 22 has a contacting portion 26 thereon. These two contacting portions 26 protrude from the main body 10 through the aperture 151 provided on the connecting portion 15. The second terminal 22 is electrically connected with the socket unit 30 and connector 40 through a transferring line 27.

The socket unit 30 comprises a third terminal 31 and the fourth terminal 32. The third terminal is made of conductive materials and has a hollow cylindrical body. A socket 34 is provided therein. The socket 34 has one opening end. The third terminal 31 is disposed in the first chamber 14 of the main body 10. The opening end of the third terminal 31 corresponds to the first aperture 18 of the main body 10. The third terminal 31 is electrically connected with the transferring line 27 such that the third terminal 31 is electrically connected with the second terminal 22 of the plug unit 20.

The fourth terminal 32 is made of conductive materials. The fourth terminal 32 is fixed on the third terminal 31 near the center of one end of the third terminal 31. An insulating piece 33 is provided between the third terminal 31 and the fourth terminal 32 for preventing short-circuiting from occurring. The fourth terminal 32 is electrically connected with the transferring line 25 such that the fourth terminal 32 is electrically connected with the first terminal 21 of the plug unit 20 and the third terminal 31 and the fourth terminal 32 of the socket unit 30 are electrically connected with the second terminal 22 and the first terminal 21 of the plug unit 20.

The connector 40 is a universal serial bus (USB) connector. The connector 40 is soldered on a circuit board 44 and is electrically connected with the circuit board 44. The connector 40 and the circuit board 44 are installed in the first chamber of the main body 10. A receiving end of the connector 40 corresponds to the second aperture 19 of the main body 10. The connector 40 and the circuit board 44 are connected with a transferring line 42 and a transferring line 43, where the transferring line 42 is electrically connected with the transferring line 25 and the transferring line 43 is electrically connected with the transferring line 27, such that the connector 40 is electrically connected with the first terminal 21 and the second terminal 22 of the plug unit 20. Alternatively, display light units 35 and 41 may be disposed on the main body 10. The display light units 35 and 41 are electrically connected with the socket unit 30 and the connector 40 respectively for displaying status of the socket unit 30 and the connector 40.

Figure 5:
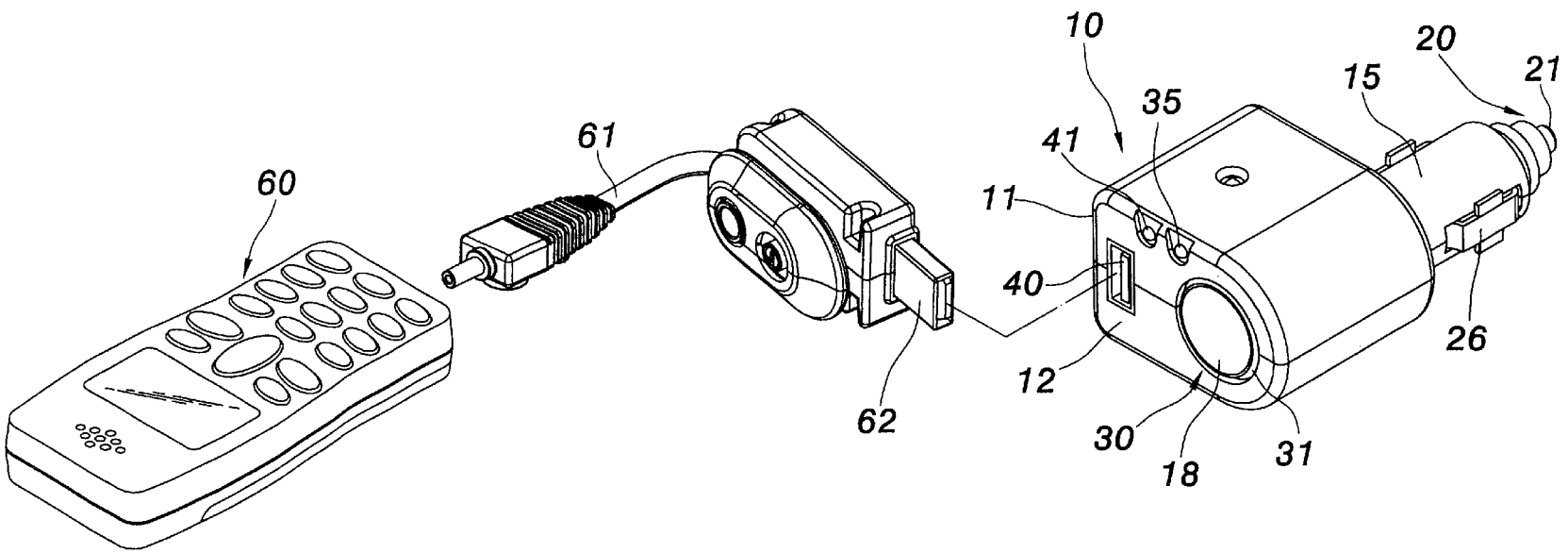
FIG. 5 is a schematic diagram showing the use of the first embodiment of this invention.

In use, the connecting portion 15 of the main body 10 is inserted into a car cigarette lighter socket (not shown). The first terminal 21 and second terminal 22 of the plug unit 20 are electrically connected with corresponding terminals of the car cigarette lighter socket, such that electric current can pass through the first terminal 21 and second terminal 22 of the plug unit 20 to the third terminal 31 and fourth terminal 32 of the socket unit 30 and the connector 40. As shown in FIG. 5, a portable electronic device 60 to be charged can connect with the connector 40 by inserting a corresponding connector 62 of a transferring line 61 of the portable electronic device 60 into the connector 40. With this configuration, the battery of the portable electronic device 60 can be charged by car.

While the adapter of this invention is implementing charging or other purposes through the connector 40, the socket unit 30 is available. For example, when the connector 40 is in use for charging, a car cigarette lighter plug or other devices can connect with the socket unit 30. Accordingly, this invention provides an adapter that is more flexible in use.

Figure 6:
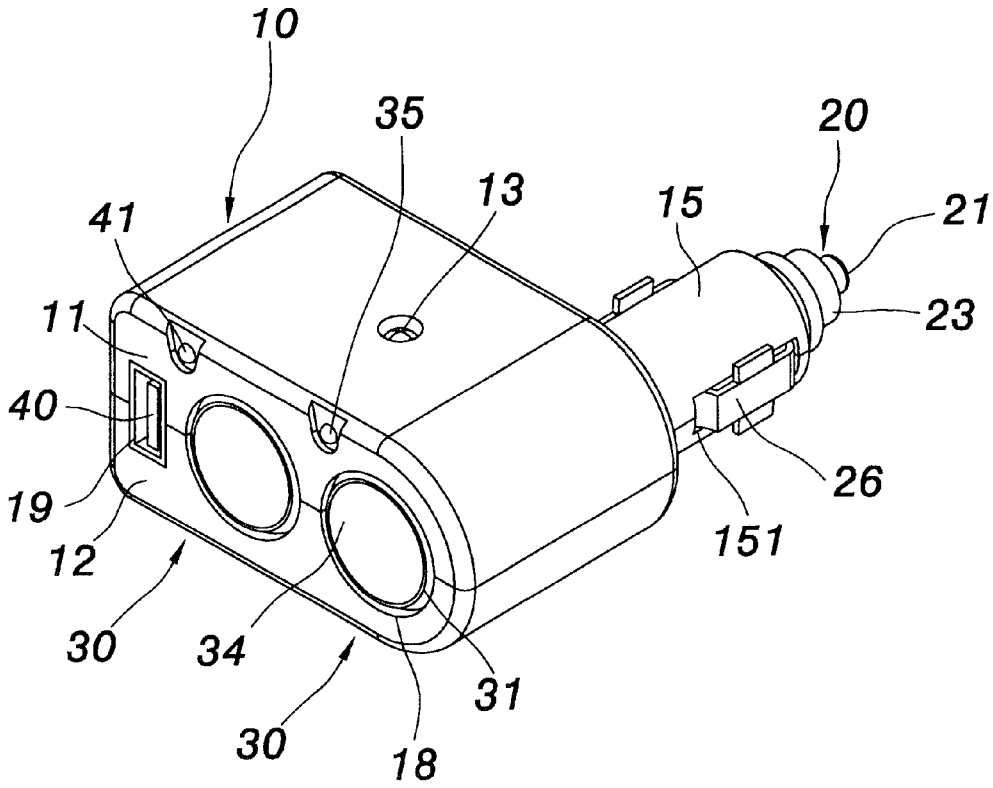
FIG. 6 is a perspective view according to a second embodiment of the present invention.

Please refer to FIG. 6. The number of the connector 40 and the socket unit 30 can be increased if desired. In FIG. 6, two socket units 30 and one connector 40 are provided.

Figure 7:
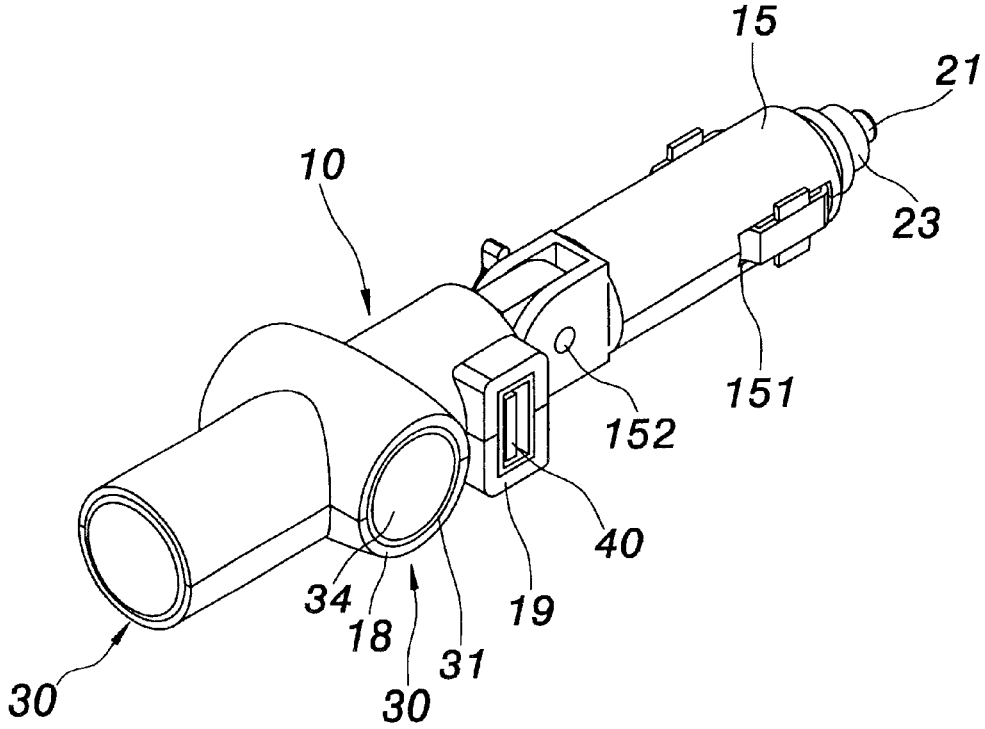
FIG. 7 is a perspective view according to a third embodiment of the present invention.
Figure 8:
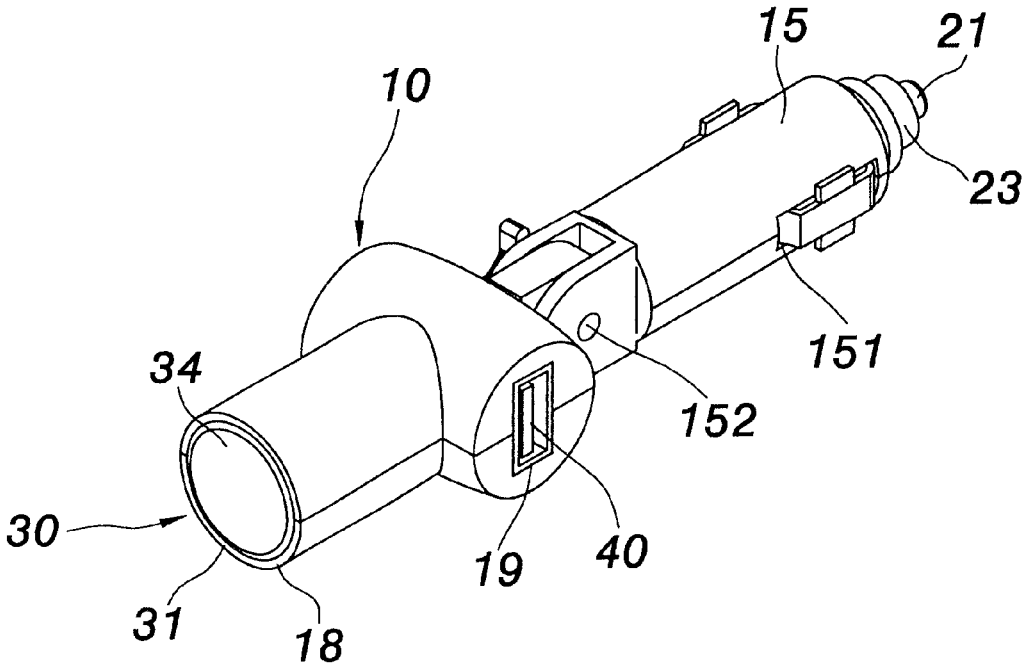
FIG. 8 is a perspective view according to a fourth embodiment of the present invention.

Please refer to FIG. 7 and FIG. 8. The shape of the main body 10 and the arrangement of the socket unit 30 and connector 40 may be changed for serving different purposes. In this embodiment as illustrated in FIG. 7, the main body 10 is cross-shaped. In the embodiment as illustrated in FIG. 8, the main body 10 is T-shaped. The socket unit 30 and the connector 40 can be arranged either on same side of the main body 10 or on opposite sides. Further, the connecting portion 15 may be pivotally connected to the main body 10 by means of a pivot pin 152, such that the connecting portion 15 is rotatable.

Figure 9:
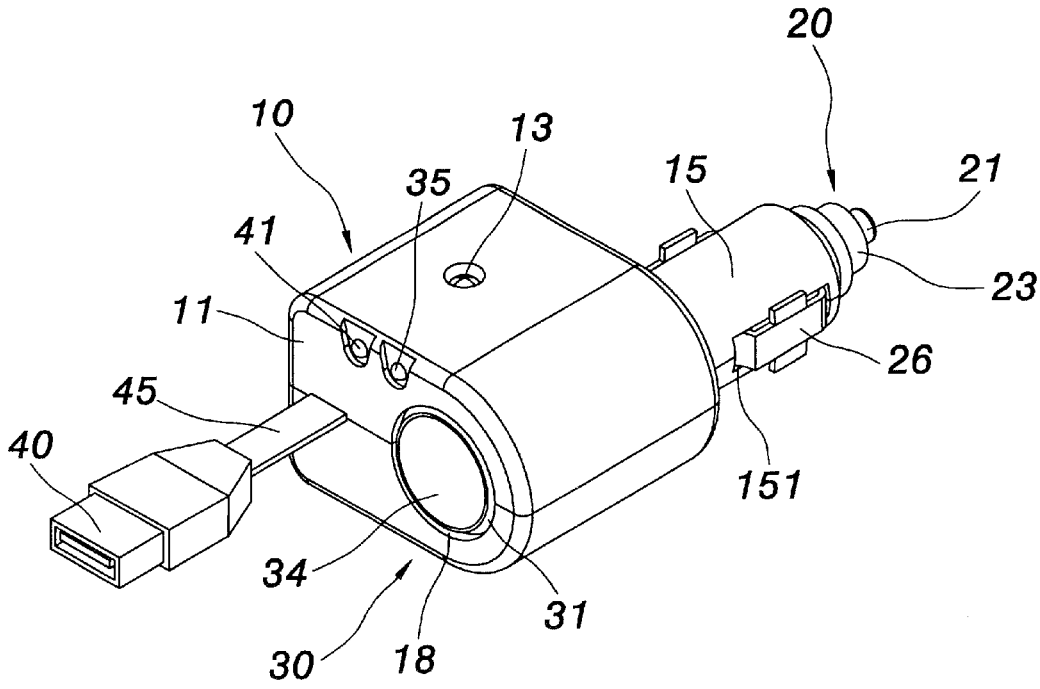
FIG. 9 is a perspective view according to a fifth embodiment of the present invention.

Please refer to FIG. 9. The connector 40 is electrically connected with the circuit board 44 through an extending transferring line 45, such that the connector 40 is electrically connected with the plug unit 20 through the transferring line 45.

Figure 10:
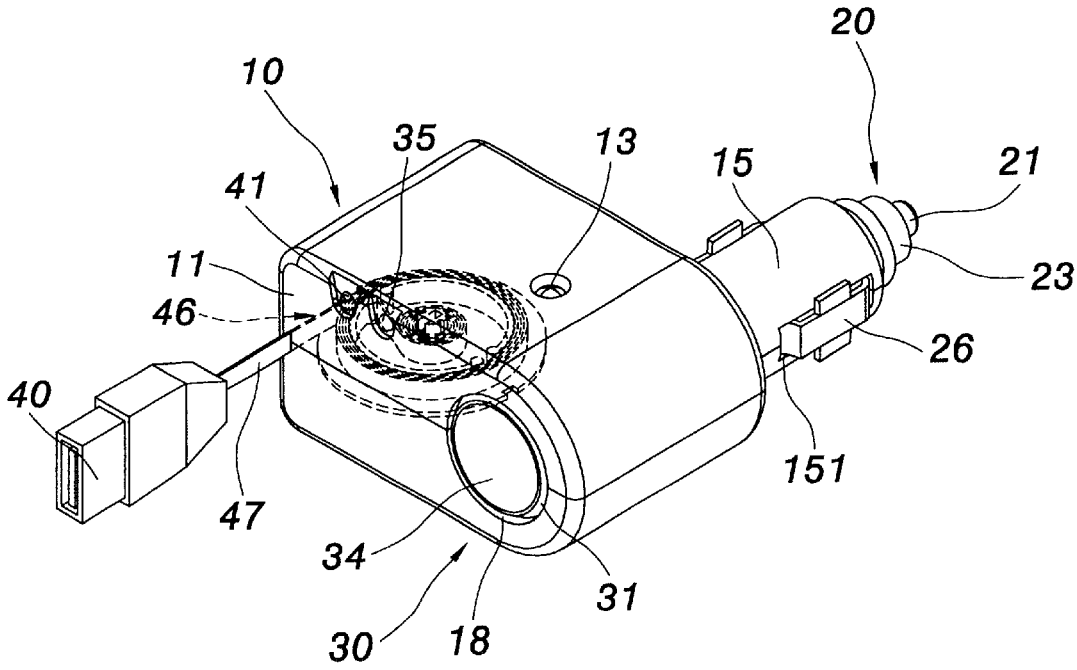
FIG. 10 is a perspective view according to a sixth embodiment of the present invention.

Please refer to FIG. 10. The connector 40 is electrically connected with the circuit board 44 through an extending transferring line 47, such that the connector 40 is electrically connected with the plug unit 20 through the transferring line 47. A swirling mechanism 46 is provided between the transferring line 47 and the circuit board 44 to automatically drawing back the transferring line 47.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A multifunctional car adapter, comprising:

a main body having a first chamber formed therein, the main body having a connecting portion extending therefrom, the connecting portion defining a second chamber;

a plug unit disposed in the second chamber, the plug unit having formed thereon first and second terminals;

at least one socket unit disposed in the first chamber and being electrically connected with the plug unit;

a circuit board disposed within the first chamber, the circuit board being electrically coupled to the plug unit for Universal Serial Bus (USB) connection thereto; and, at least one USB connector coupled to the circuit board, the USB connector being thereby electrically connected with the plug unit for concurrent use with the socket unit.

2. The multifunctional car adapter of claim 1 wherein display light unit is disposed on the main body and is electrically connected with the socket unit for displaying status of the socket unit.

3. The multifunctional car adapter of claim 1 wherein display light unit is disposed on the main body and is electrically connected with the connector for displaying status of the connector.

4. The multifunctional car adapter of claim 1 wherein the main body has a first aperture thereon and one end of the socket unit corresponds to the first aperture.

5. The multifunctional car adapter of claim 4 wherein the main body has a second aperture thereon and one end of the connector corresponds to the second aperture.

6. The multifunctional car adapter of claim 1 wherein the second chamber is connected to the first chamber of the main body.

7. The multifunctional car adapter of claim 1 wherein the connecting portion is pivotally connected to the main body.

8. The multifunctional car adapter of claim 1 wherein the connecting portion is pivotally connected to the main body by means of a pivot pin so that the connecting portion is rotatable.

9. The multifunctional car adapter of claim 1 wherein the plug unit comprises a first terminal and a second terminal, the first terminal being movably installed on a base that is fastened in an opening at a distal end of the second chamber, the first terminal protruding from an outer surface of the base, the first terminal being disposed at the center of the connecting portion, a spring being connected with the first terminal for pushing the first terminal out of the base, one end of the spring being connected with a fourth terminal and the connector through a first transferring line, the second terminal being disposed and fixed in the second chamber, the second terminal being folded in a shape such that each end of the second terminal has a contacting portion thereon, the contacting portions protruding from the main body through an aperture provided on the connecting portion, the second terminal being electrically connected with the socket unit and the connector through a second transferring line.

10. The multifunctional car adapter of claim 9 wherein the socket unit comprises a third terminal and a fourth terminal, the third terminal having a hollow cylindrical body, a socket being provided therein, the socket having one opening end, the third terminal being disposed in the first chamber of the main body, the opening end of the third terminal corresponding to the first opening of the main body, the third terminal being electrically connected with the transferring line such that the third terminal is electrically connected with the second terminal of the plug unit, the fourth terminal being fixed on the third terminal near the center of one end of the third terminal, an insulating piece being provided between the third terminal and the fourth terminal for preventing a short-circuiting condition.

11. The multifunctional car adapter of claim 1 comprising a plurality of socket units.

12. The multifunctional car adapter of claim 1 wherein the connector is electrically connected with the circuit board, the circuit board is electrically connected with the plug unit by means of a transferring line.

13. The multifunctional car adapter of claim 1 wherein the connector is electrically connected with the circuit board through a transferring line extending from the main body.

14. The multifunctional car adapter of claim 1 wherein the connector is electrically connected with the circuit board through a transferring line extendable from the main body, a swirling mechanism being provided between the transferring line and the circuit board to automatically retract the transferring line.

15. A multifunctional car adapter, comprising:

a main body having a first chamber formed therein, the main body having a connecting portion extending therefrom, the connecting portion defining a second chamber;

a plug unit disposed in the second chamber, the plug unit having formed thereon first and second terminals;

at least one socket unit disposed in the first chamber and being electrically connected with the plug unit;

a circuit board disposed within the first chamber, the circuit board being electrically coupled to the plug unit for Universal Serial Bus (USB) connection thereto;

at least one USB connector coupled to the circuit board by a flexible transferring line extendable from the main body, the USB connection being thereby electrically connected with the plug unit, and, a swirling mechanism rotatably disposed in the first chamber for releasably stowing at least a portion of the transferring line thereabout, the swirling mechanism being biased to retract the transferring line to a spooled configuration.

16. A multifunctional car adapter, comprising:

a main body having a first chamber formed therein, the main body having a connecting portion extending therefrom, the connecting portion defining a second chamber;

a plug unit disposed in the second chamber, the plug unit having formed thereon first and second terminals;

at least one socket unit disposed in the first chamber and being electrically connected with the plug unit by engaging a socket terminal;

a circuit board disposed within the first chamber, the circuit board being electrically coupled to the plug unit for Universal Serial Bus (USB) connection thereto, said circuit board being mounted to a conductive bracket member extending at least partially between the first and second chambers, the conductive bracket member supporting the socket terminal in electrically insulated manner; and, at least one USB connector coupled to the circuit board, the USB connector being thereby electrically connected with the plug unit.

* * * * *